United States Patent [19]

Minasy

[11] 4,299,040

[45] Nov. 10, 1981

[54] FASTENING MEANS

[75] Inventor: Arthur J. Minasy, Woodbury, N.Y.

[73] Assignee: Knogo Corporation, Hicksville, N.Y.

[21] Appl. No.: 618,254

[22] Filed: Sep. 30, 1975

[51] Int. Cl.[3] ..... G09F 3/08; A44B 1/18

[52] U.S. Cl. ..... 40/20 R; 24/90 R

[58] Field of Search ..... 24/90 D, 90 B, 113 R, 24/113 MP, 150 P, 150 FP, 152, 101 S, 101 R, 90 E, 90 R; 40/20 R

[56] References Cited

U.S. PATENT DOCUMENTS

| | | | |
|---|---|---|---|
| 1,031,317 | 7/1912 | Barbour, Jr. | 24/113 R |
| 1,648,033 | 11/1927 | Thompson | 24/90 D |
| 3,470,637 | 10/1969 | Daddona, Jr. | 40/20 |
| 3,942,224 | 3/1976 | Benmax . | |

FOREIGN PATENT DOCUMENTS 656084 1/1938 Fed. Rep. of Germany .

*Primary Examiner*—Kenneth Dorner

*Attorney, Agent, or Firm*—Fitzpatrick, Cella, Harper & Scinto

[57] ABSTRACT

A fastening means for fastening a wafer to an article of merchandise and comprising a tack-like element whose shank passes through the merchandise and the wafer and a button-like fastening element which securely holds the shank of the tack-like element. The head of the tack-like element is freely rotated and tiltable on the shank to resist unauthorized efforts to release the fastening means.

4 Claims, 7 Drawing Figures

FASTENING MEANS

BACKGROUND OF THE INVENTION

1. Field of the Invention

This invention relates to fastening devices and more particularly it concerns novel tack-like fastening devices which are highly resistant to unauthorized release by fracturing or the like.

2. Description of the Prior Art

U.S. Pat. No. 3,628,267 to A. J. Minasy and U.S. Pat. No. 3,858,280 to M. A. J. Martins show tack-like fastening devices used to hold a plastic wafer to an article of merchandise. The plastic wafer serves, externally, as a label on which price, size, etc., pertaining to the merchandise may be printed. Inside the wafer, however, there is embedded an electronic circuit; and if the merchandise is taken through a door or other specially wired exit the electronic circuit in the wafer will cause an alarm to be sounded. A system suitable for providing this alarm is described in U.S. Pat. No. 3,500,373 to A. J. Minasy.

It is important that the wafer fastening device be capable of holding the wafer securely to the merchandise and that it be highly resistant to release in an unauthorized manner. It is also important that the fastening device does not harm the merchandise. In general, the fastening devices employed to secure wafers to articles of merchandise comprise a tack-like element having an expansive, generally flat, head with a thin pointed shank extending out from the center of one side of the head. The shank pierces the merchandise and passes through a small opening in the wafer. It then enters a button-like fastening element and becomes locked therein by some means which can be released only by a special device at a checkout counter or authorization station.

One technique that has been used in the past to remove wafers from articles of merchandise without authorization is to exert sharp pulling forces between the merchandise material and the wafer to pull up on one side of the tack head and bend its shank. If this pulling is done in a particular manner it may be possible to bend the shank sufficiently to sever it and thereby release the wafer from the merchandise.

SUMMARY OF THE INVENTION

The present invention overcomes the above described difficulties of the prior art. With the present invention there is provided a novel tack-like fastening arrangement which is not susceptible to fracturing and release by bending as above described. The present invention thereby substantially improves the effectiveness and security provided by electronic systems designed to protect merchandise against theft.

According to one aspect of the present invention there is provided a novel tack-like fastening element. This novel fastening element comprises a thin elongated shank attached at one end to an expansive head, with the head being freely tiltable with respect to the longitudinal axis of the shank. Because the head is freely tiltable it will not convert pulling forces applied at its edge to shank bending forces. Preferably the head is also freely rotatable on the shank so that a steady prying force is difficult to maintain and so that any shank bending which is produced in one direction cannot thereafter be produced in the opposite direction.

According to another aspect of the invention there is provided a novel fastener assembly for fastening a wafer to an article of merchandise. This novel fastener assembly comprises a tack-like fastening element having a thin elongated shank attached at one end to an expansive head, with the head freely tiltable with respect to the longitudinal axis of the shank. The shank passes through an article of merchandise and a wafer. A fastener is provided on the opposite side of the wafer from the expansive head. This fastener accommodates the other end of the shank and holds the shank tightly to it. Because the head is freely tiltable with respect to the longitudinal axis of the shank it prevents pulling or prying forces, applied to the head of the tack-like fastening element, from causing bending of its shank. Also, the head of the tack-like fastening element is preferably freely rotatable on the shank. This serves to isolate the shank gripping action of the fastener from any rotation of the head of the tack-like fastening element.

There has thus been outlined rather broadly the more important features of the invention in order that the detailed description thereof that follows may be better understood, and in order that the present contribution in the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

A single embodiment of the invention has been chosen for purposes of illustration and description and is shown in the accompanying drawings forming a part of this specification, wherein.

DETAILED DESCRIPTION OF THE PREFERRED EMBODIMENT

Figure 1:
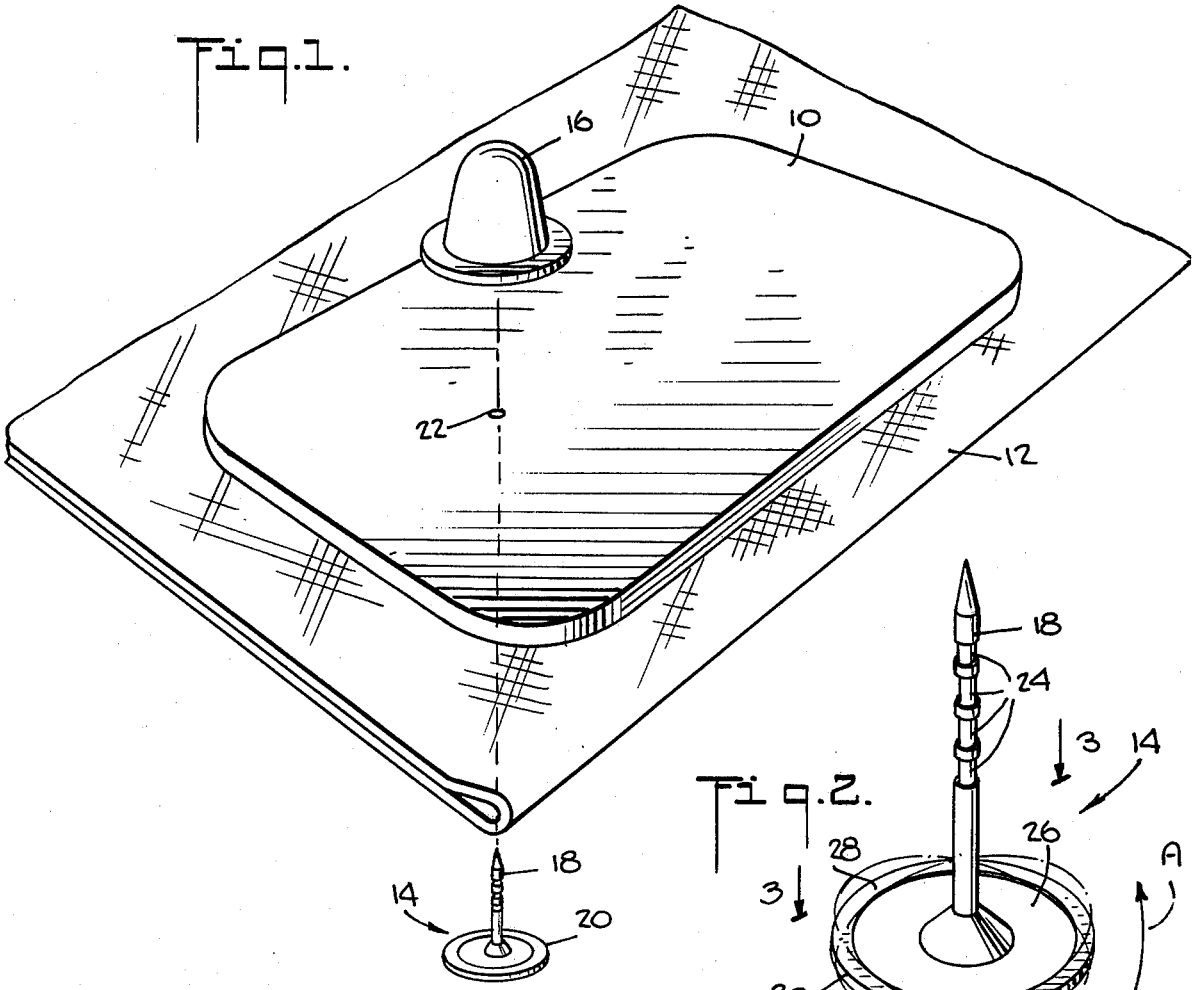
FIG. 1 is an exploded perspective view showing a fastener assembly for fastening a wafer to an article of merchandise in accordance with the present invention.

As shown in FIG. 1 a wafer 10 is secured to an article of merchandise 12, which may, for example, be a portion of a coat sleeve or the like. The wafer 10, may be in the form of a label and it may carry selling information pertaining to the merchandise, such as price, size, etc. In addition, the wafer may have embedded therein an electronic circuit in accordance with Minasy U.S. Pat. No. 3,500,373 for protecting the merchandise against theft.

The wafer 10 is held to the merchandise 12 by means of a fastener assembly comprising a tack-like fastening element 14 and a fastening button 16. The fastening element 14 comprises a thin elongated shank 18 pointed at one end and attached at its opposite end to an expansive disk-like head 20. The shank 18 passes through the merchandise 12 and through a hole 22 in the wafer 10. The pointed end of the shank 18 then enters the fastening button 16 which holds it tightly in place.

Figure 2:
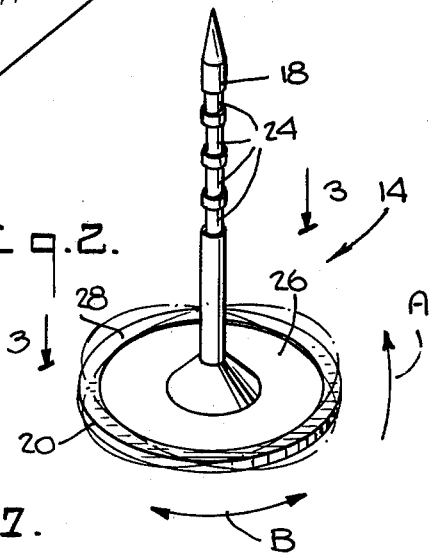
FIG. 2 is an enlarged perspective view of a tack-like fastening element used in the assembly of FIG. 1.
Figure 3:
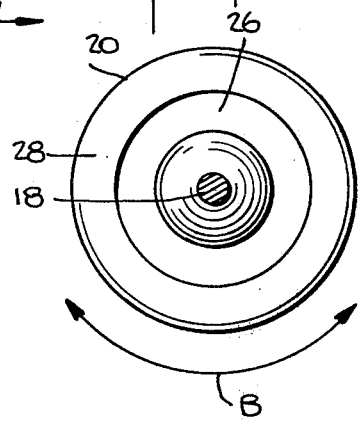
FIG. 3 is a cross section view taken along line 3—3 of FIG. 2.

FIGS. 2 and 3 show the fastening element 14 in greater detail. As can be seen, the shank 18 is pointed at its outer end so that it can pierce the merchandise without damaging it. Also, the shank 18 is formed with several axially spaced circumferential grooves 24 which enable the shank to be gripped more easily in the fastening button 16. The head 20 comprises a washer portion 26, through which the shank 18 passes, and a cover 28 which extends over the back of the washer portion and is crimped thereto about its periphery.

The fastening element 14 is specially characterized in that the head 20 may tilt freely, as indicated by the arrow A in FIG. 2, with respect to the longitudinal axis of the shank 18. This tilt is preferably at least five degrees in all directions from a plane perpendicular to the longitudinal axis of the shank. The fastening element 14 is also characterized in that the head 20 may rotate freely, as indicated by the arrow B in FIG. 2, about the longitudinal axis of the shank 18. The free tilting characteristic of the fastener head, as will be explained, enables the fastening element to resist attempts to break off the shank by prying under the head. The free rotation of the head 20 with respect to the shank 18 further improves the ability of the fastening element to resist such unauthorized attempts to release the device.

Figure 4:
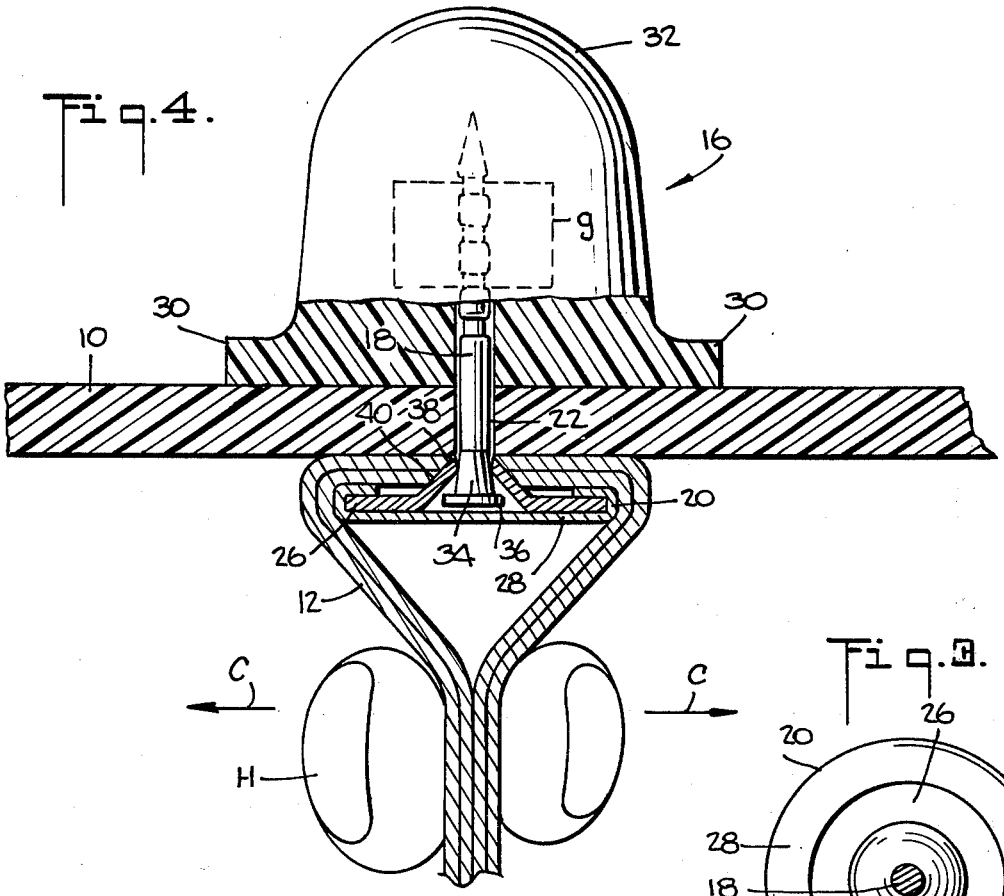
FIGS. 4 and 5 are enlarged section view of the fastener assembly of FIG. 1 and are illustrative of how the fastener assembly resists unauthorized attempts to release same.
Figure 5:
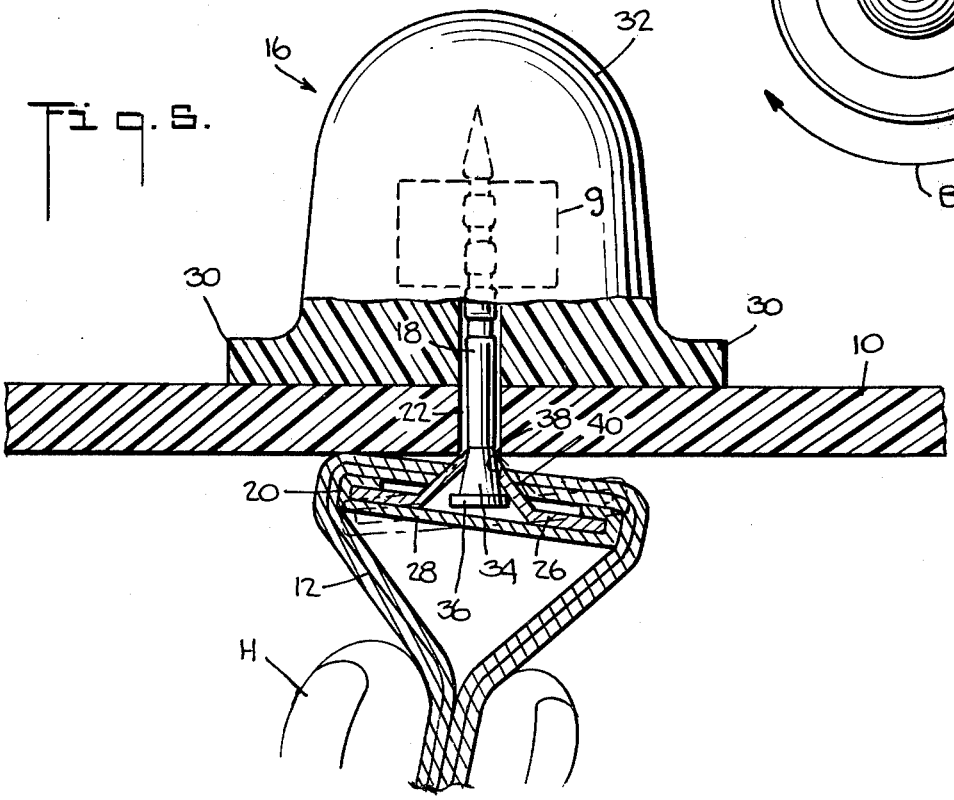

FIGS. 4 and 5 show in greater detail the construction and operation of the label fastening assembly of the present invention. As can be seen in these drawings, the fastener shank 18 pierces the merchandise 12 and passes through the opening 22 in the wafer 10 before entering into the fastening button 16. The fastening button 16 grips the shank 18 of the fastening element 14 and holds it firmly with the head 20 of the fastening element pressed firmly against the merchandise 12. The particular manner in which the fastening button 16 holds the shank 18 forms no part of the present invention; and since many holding arrangements, e.g., a clinched over shank and embedded in the button material, locking clips, etc. are known and used, the shank holding arrangement is merely indicated in the drawings by a box "g" shown in dashed outline.

The fastening button 16 has a flange 30 which presses against the upper side of the wafer 10 and it has a dome shaped central portion 32 which encloses the fastening element shank 18. In some cases the button 16 may be permanently sealed or formed integrally with the wafer 10.

FIGS. 4 and 5 also illustrate the construction details of the fastening element shank 18 and head 20. As can be seen, the base of the shank 18 is formed with a slight diverging portion 34 which terminates in a flange-like lip 36. The washer portion 26 is of disk-like configuration and it has a central opening 38 therethrough which is surrounded by a conically shaped depression 40. The central opening 38 is slightly larger in diameter than the main portion of the fastening element shank 18. However the central opening 38 is not large enough to accommodate the flange-like lip 36 on the end of the shank; and this lip, along with the adjacent part of the diverging portion 34, is accommodated in the conically shaped depression 40. With this arrangement the washer portion 26 can tilt freely in every direction with respect to the longitudinal axis of the shank 18 through an angle of at least five degrees with respect to a plane perpendicular to the shank axis. At the same time the interconnection between the shank and washer portion can withstand a very substantial tensile pull in the direction of the shank axis. The cover 28 is of sheet metal and it covers the depression 40 containing the lip 36 and diverging portion 34 of the fastener shank 18. The cover 28 is bent around and crimped under the peripheral edge of the washer portion 26 to protect the lip 36 and diverging portion 34 of the shank 18 from tampering.

In normal use, the above described fastener assembly holds the wafer 10 to the merchandise 12 in a very secure manner. Generally, the wafer 10 is removed from the merchandise at the time of sale; and this is done at a counter or stand where special releasing machinery is kept. The manner in which the releasing machinery operates depends upon the particular shank holding arrangement "g" employed in the fastening button 16. In some cases, for example, the releasing machinery may take the form of a cutter with a guillotine type blade which severs both the button 16 and the fastener shank 18. In other cases, where the shank holding arrangement "g" is magnetically responsive, the releasing machinery may comprise a powerful electromagnet. In any event, the fastening arrangement is designed so that the type of equipment needed to release it is much larger than anything that can be used in a surreptitious manner by a shoplifter or a thief.

In prior fastening arrangements it was found that by gathering the merchandise 12 around the fastener head and then repeatedly jerking it in a particular manner, one could, in some instances, pry up on one side of the fastener element head and cause a bending of the fastener shank. If this bending were repeated the shank would become embrittled through work hardening and would break so that the wafer could be separated from the merchandise. Also, in some cases, the fastener could be released by rotating the fastener head so that the shank would turn inside the fastener button. By careful coordination of fastener rotation and pulling on the fastener, its shank could sometimes be made to unscrew from the fastening button.

The manner in which the present invention resists unauthorized fastener release through the above described techniques will now be described in conjunction with FIGS. 4 and 5. In FIG. 4 the merchandise is shown as grasped in a hand H so that it is gathered around the head 20 of the fastener element 14 for pulling or jerking against the head from side to side as indicated by the arrow C. As shown in FIG. 5, however, when the merchandise is pulled to one side, i.e. to the left, and a downward pull is exerted on the right side of the head 20, the head merely tilts with respect to the shank and the shank remains straight and extends directly up into the button 16. Thus all lateral prying and jerking forces are automatically converted to pure tensile forces which the fastening button can resist. Moreover the shank 18 is not subjected to bending which might cause work hardening and breakage. In addition, because the head 20 is freely rotatable with respect to the shank it is not possible to unscrew the shank from the fastening button by rotation of the head.

Figure 6:
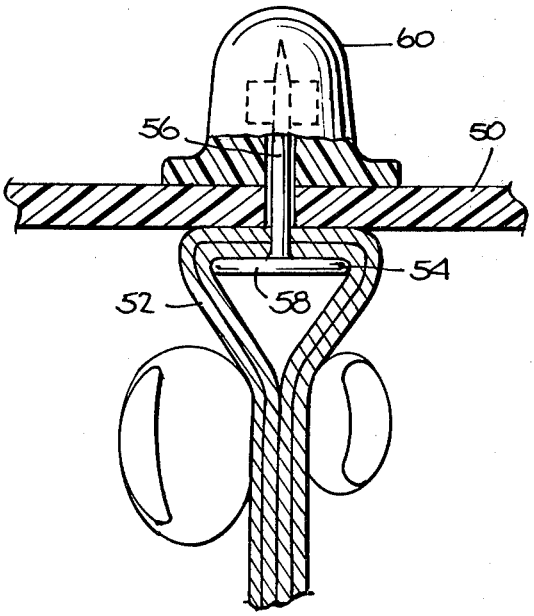
Fig.6. PRIOR ART
FIGS. 6 and 7 are cross sectional views similar to FIGS. 4 and 5 but showing a prior art fastener assembly undergoing an attempt to release same in an unauthorized manner.
Figure 7:
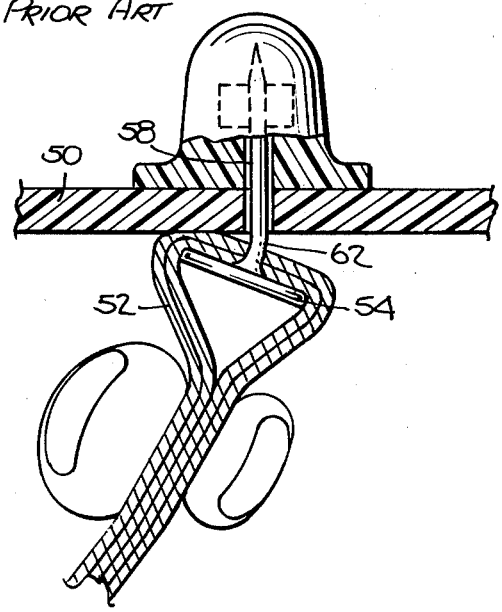
Fig.7. PRIOR ART

FIGS. 6 and 7 show how a prior art fastener assembly can be released in an unauthorized manner. As shown in FIG. 6 a wafer 50 is held to an article of merchandise 52 by means of a fastener element 54 having an elongated shank 56 solidly fixed to a head 58 with the shank passing through the merchandise and wafer and secured on the opposite side of the wafer by means of a fastener button 60. When the merchandise 52 is grasped and jerked to the side, a prying and tilting action is provided on the head 58 of the fastener; and this in turn causes the shank 56 to bend as indicated at 62 in FIG. 7. A repeated bending of the shank at this location will eventually cause it to break and allow release of the wafer from the merchandise. Also, by grasping the head 58 and rotating it, the shank 56 may be made to turn inside the button 60; and by judicious turning and pulling the button 60 may be caused to release the shank.

The present invention as described herein, which employs a fastener element with a freely tiltable and rotatable head, serves to prevent the bending and unscrewing action which permitted unauthorized release of prior art fasteners.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A tamper resistant, nonseparable tack fastener assembly comprising a thin wafer positioned against a sheet shaped portion of an article of merchandise, a tack-like fastener element having an expansive head and a thin elongated shank said shank extending through said article of merchandise and said wafer, and a thick button element having an opening for closely accommodating said shank and pressing said article and said wafer tightly between itself and said expansive head of said tack-like fastener element and including means for solidly interlocking said button and fastener element together; means connecting said shank and said head to permit the latter freely to tilt with respect to the longitudinal axis of said shank.

2. A fastener assembly according to claim 1 wherein said head tilts freely in all directions with respect to said shank.

3. A fastener assembly according to claim 1 wherein said head rotates freely on said shank.

4. A fastener assembly according to claim 1 wherein said head tilts freely in all directions by at least five degrees from a plane perpendicular to the longitudinal axis of said shank.

* * * * *